United States Patent [19]

Simmons

[11] Patent Number: 4,458,564

[45] Date of Patent: Jul. 10, 1984

[54] RADIATOR CAP REMOVER

[76] Inventor: George Simmons, Rte. 2, Box 240, Buchanan, Tenn. 38222

[21] Appl. No.: 439,628

[22] Filed: Nov. 5, 1982

[51] Int. Cl.[3] ..... B25B 7/02

[52] U.S. Cl. ..... 81/426; 81/3.44

[58] Field of Search ..... 81/425 R, 426, 3.34, 81/3.4, 3.42, 3.44, 90 R, 90 B

[56] References Cited

U.S. PATENT DOCUMENTS 2,931,258 4/1960 Ronning ..... 81/3.44

FOREIGN PATENT DOCUMENTS 1068568 2/1954 France ..... 81/3.44

*Primary Examiner*—Frederick R. Schmidt
*Assistant Examiner*—J. T. Zatarga
*Attorney, Agent, or Firm*—King and Liles

[57] ABSTRACT

A tool adapted to align and interact with a radiator cap to assist in the removal of the cap from a radiator has a pliers type arrangement of levers with uniquely constructed end effectors. One of the end effectors includes a substantially planar alignment plate with a depending skirt extending less than 180° about a peripheral sector of the alignment plate. The alignment plate orients the tool with the top of the radiator cap, and the skirt angularly orients the tool to positively abut a lug on the radiator cap with the skirt sidewall. The other end effector is a relatively narrow gripping jaw which cooperatively interacts with the alignment plate and skirt to compressively engage an interposed radiator cap as the handle on the levers are manually moved toward each other. The levers mechanically multiply both compressive force manually applied to the levers to firmly grasp the cap, and the torque applied to unscrew the cap from the radiator.

6 Claims, 5 Drawing Figures

RADIATOR CAP REMOVER

TECHNICAL FIELD

The invention relates to an apparatus for removing radiator caps from radiators and more particularly concerns a pair of cooperating levers with end engaging portions adapted to firmly grasp a conventional radiator cap for turning, lifting and removal of the cap from the radiator while the radiator cap is hot and/or firmly engaged with the radiator. The specially adapted configuration of the cooperating levers operates to both align the apparatus upon the radiator cap and firmly grasp the cap for removal.

BACKGROUND OF THE INVENTION

Most contemporary automobiles have water cooled engines with radiators to effectuate heat transfer from the cooling water to the ambient air. The typical radiator has a removable cap threadably received by the radiator to selectively open a passageway and permit the introduction of cooling water or other fluid media into the radiator interior. The radiator cap generally has a pair of radially extending lugs designed as abutment surfaces to assist in manually twisting the cap as it is being unscrewed for removal. Conventionally, radiators, including radiator caps, have been made of highly thermally conductive metal material and have been in direct contact with cooling media flowing through the radiator during engine operation. Due to the high temperature reached by the cooling media during engine operation and the high thermal conductivity of the materials involved, radiator caps often become too hot for manual removal from the radiator. Thus, removal of the cap is often delayed for a substantial period after the engine is shut off to permit the cooling of the entire radiator structure. Removal of the radiator cap from the radiator is also frequently hindered by bonding of the cap and radiator after the cap has been secured to the radiator for a prolonged period of time.

Attempts have been made in the past to facilitate removal of hot radiator caps. One such tool is shown in U.S. Pat. No. 3,035,466 wherein a hand tool with a planar surface is provided with a plurality of angularly extending ears. The planar surface and the attached ears are rotated by a rotating mechanism to unscrew the cap from the radiator opening and thereafter lift the cap for removal therefrom. The radiator cap remover of the above mentioned patent uses a lever to manually rotate a radiator cap engaging member to bring ears on the engaging member in abutment with lugs on the radiator cap. This prior art device requires two hands for effective operation and does not firmly grasp the radiator cap after the cap is removed from the radiator.

SUMMARY OF THE INVENTION

The present invention advances the teachings of the prior art by providing a tool for aligning, grasping and thereafter removing hot and/or hard to remove radiator caps from radiators with only one hand. The tool includes a pair of pivotally attached levers with an alignment surface and a gripping jaw on cooperating ends. The alignment surface is substantially planar and includes a peripheral sector of arcuate configuration. An orthogonally disposed skirt depends from the arcuate peripheral sector of the alignment for less than 180°, and the arcuate extremities of the skirt form abutment surfaces for positively abutting lugs on the radiator cap.

The gripping jaw is relatively narrow to produce high unit forces and is adapted to engage the opposite side of the radiator cap from that engaged by the skirt and to apply a relatively high compressive force to firmly grasp the interposed cap when the paired levers are manually squeezed together.

It is therefore an object of the present invention to provide a tool for aligning upon a hot and/or hard to remove radiator cap and thereafter firmly girpping the cap for unscrewing and lifting the cap from the radiator.

It is a further object of the present invention to provide a radiator cap removal tool with positive engagement means to abut lugs on a radiator cap with mechanically multiplied forces.

It is a further object of the present invention to provide a single but effective tool for removing hot and/or hard to remove radiator caps from radiators with only one hand.

BRIEF DESCRIPTION OF THE DRAWINGS

The accompanying drawings incorporated in and forming a part of the specification illustrate several aspects of the present invention, and together with the description serve to explain the principles of the invention.

In the drawings.

Reference will now be made in detail to the present preferred embodiment of the invention, an example of which is illustrated in the accompanying drawings.

BEST MODE OF CARRYING OUT THE INVENTION

Figure 1:
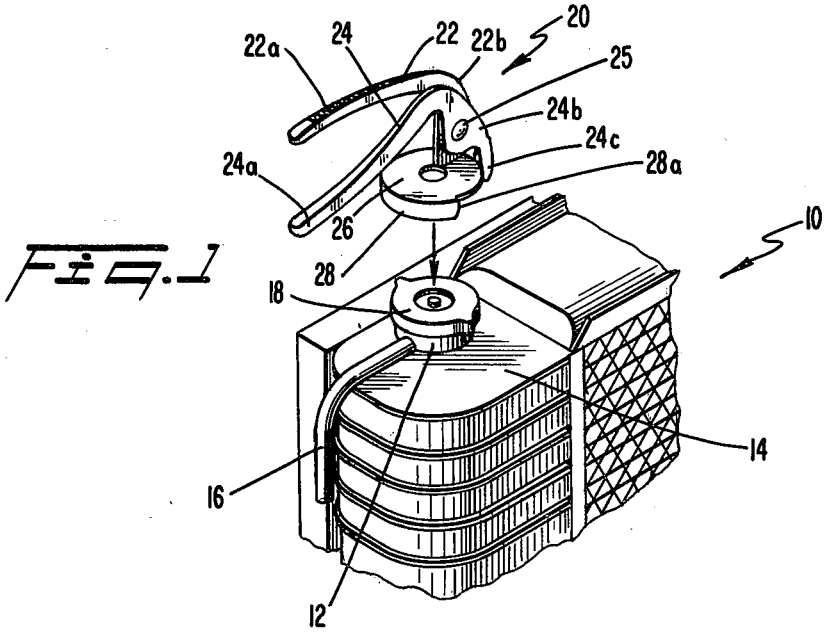
FIG. 1 is a fragmentary perspective view of an automobile radiator with a radiator cap threadably secured to an opening in the top of the radiator and a radiator cap removal tool in accordance with the present invention positioned directly above the radiator cap.

Reference will now be made to the drawings in which FIG. 1 depicts an upper corner of an automobile radiator 10. The radiator 10 includes a cylindrically shaped neck 12 extending upwardly from a top plate 14 of the radiator 10. The neck 12 is hollow with a top opening and defines a fluid passage to the interior of the radiator 10. As will be apparent to those skilled in the art, the neck 12 leads to a nonillustrated serpentine heat exchange flow path within the radiator. As is conventional, a flexible overflow hose 16 extends radially outwardly from the neck 12 for discharging overflow fluid from the radiator 10. The upper portion of the neck 12 also threadably receives a radiator cap 18 which is removable from the neck 12 to facilitate introduction of a heat transfer fluid into the radiator 10. The cap 18 is rotated and thereafter removed from the radiator 10 to provide access to the opening in the neck 12. Radiators and radiator caps as thus far described are well known and widely used in water cooled internal combustion engines. Thus, further description of the radiator 10 and cap 18 is omitted for brevity.

A radiator cap removal tool 20 in accordance with the present invention is illustrated in FIG. 1 in a position vertically above the radiator cap 18. The radiator cap removal tool includes a pair of generally L-shaped levers 22 and 24 rotatably secured to each other about a pivot pin 25. A first lever 22 of the pair of L-shaped levers includes a handle portion or leg 22*a* extending in a first predetermined direction. A second or end effector leg 22*b* of the lever's (22) L-shaped configuration extends in a direction substantially perpendicular to the handle portion 22*a* to support a substantially planar alignment plate 26. The alignment plate 26 has a circular configuration and lies in a plane substantially perpendicular to the plane defined by the legs 22*a*, 22*b* of the first lever 22.

A downwardly depending skirt 28 orthogonally extends from an arcuate peripheral sector of the alignment plate in a direction mutually perpendicular to both the alignment plate and the plane formed by legs 22*a*, 22*b*. The peripheral sector from which the skirt 28 depends extends for slightly less than 180° and enables the arcuate extremities or end walls 28*a* and 28*b* of the skirt 28 to engage radially outwardly extending lugs 18*a*, 18*b* of the radiator cap 18. The downwardly extending skirt 28 extends approximately equal circumferential distances on each side of the handle 22*a* of the lever 24 so that the lever 22 corresponds to the arcuate center of the skirt 28. In the preferred embodiment, the skirt extends for approximately 170°, approximately 85° on each side of the lever 24.

The second (24) of the paired L-shaped levers includes a handle portion or leg 24*a* extending in a third predetermined direction and integrally attached to the gripping portion 24*b*. The handle leg 24*a* extends in a fourth predetermined direction in substantially parallel spaced relationship to the handle portion 22*a*. The gripping portion 24*b* terminates in a gripping portion 24*c*, the gripping portion 24*c* being relatively narrow in comparison to the arcuate skirt 28. The levers 22 and 24 are intimately positioned with respect to each other in closely spaced planes to locate the gripping surface 24*c* about the alignment surface 26 opposite the arcuate center of the skirt 28.

Figure 2:
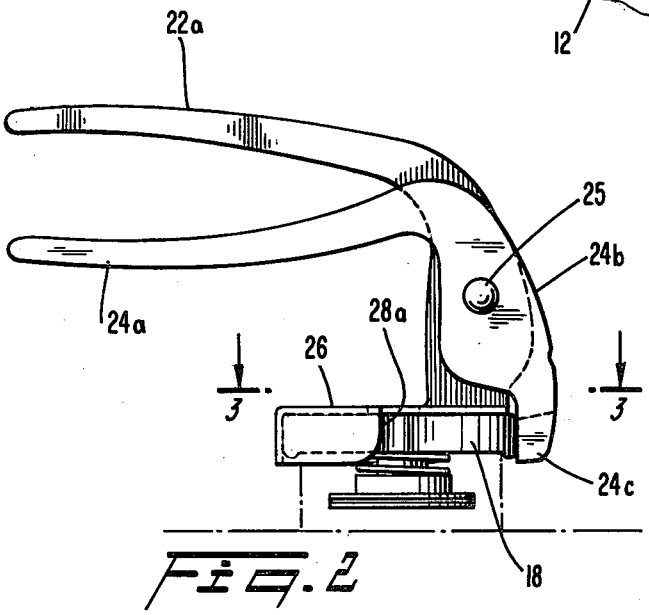
FIG. 2 is a side elevational view of the radiator cap removal tool of FIG. 1 depicting the tool guided into position and firmly engaging the radiator cap after the cap has been removed from the radiator.
Figure 3:
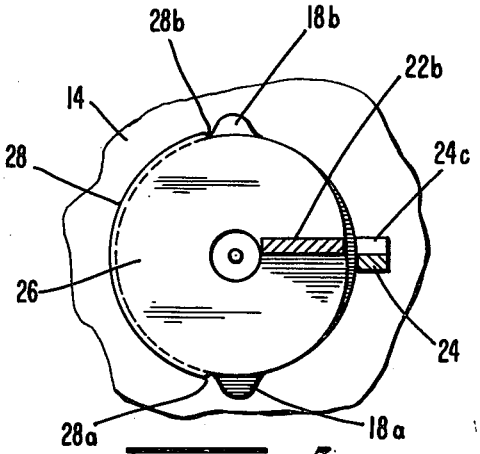
FIG. 3 is a cross sectional view taken along line 3—3 in FIG. 2 illustrating an alignment plate secured to one of the levers of the removal tool in aligned engagement with the radiator cap.
Figure 4:
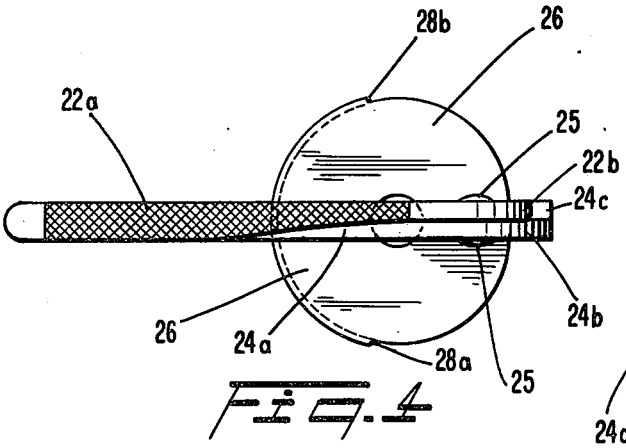
FIG. 4 is a plan view of the radiator cap removal tool of FIG. 2.
Figure 5:
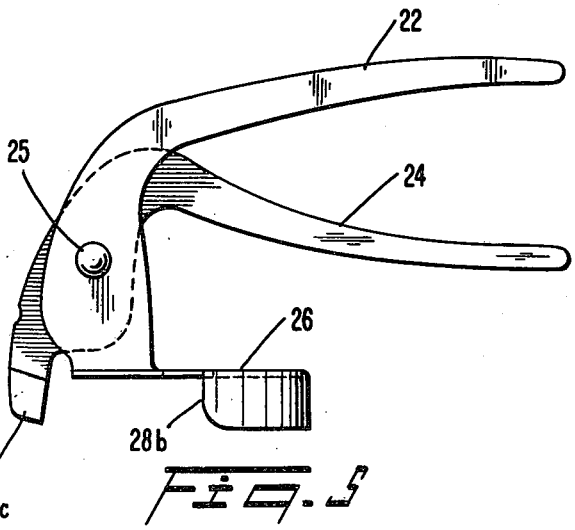
FIG. 5 is a side elevational view of the removal tool taken from the opposite side of the FIG. 2 depiction with the radiator cap removed for clarity of illustration.

As best seen in FIGS. 2, 3 and 5, the end effector leg 22*b* of lever 24 is integrally joined to the top of the alignment surface 26 proximal to the peripheral edge of the alignment surface opposite the downwardly depending skirt 28. Joining the engaging leg 22*a* and the aligning surface 26 at this location permits pivot pin 25 to be near both the alignment plate and the gripping jaw 24*c*, increasing the mechanical advantage for the pivotal levers 22, 24.

The advantages of appliant's construction details may be best realized from viewing FIGS. 2 and 3 depicting the working relationship between the structure of the radiator cap and the tool of the present invention. The alignment plate 26 is positioned upon the top of the radiator cap 18 in mating planar relationship therewith. Orienting the alignment plate in this manner thus places the depending arcuate skirt 28 in parallel relationship with the sidewalls of the radiator cap. The tool is then moved forwardly to bring the skirt 28 into contacting relationship with the radiator cap sidewalls. Engaging the skirt 28 with the radiator cap sidewalls not only centers the alignment plate with respect to the radiator cap, the arcuate extremities or end wall 28*a*, 28*b* of the skirt 28 cooperate with the radiator cap lugs 18*a*, 18*b* to guide the tool 20 into an angular relationship with the cap that places the skirt extremities 28*a*, 28*b* into rotational engagement with the lugs 18*a*, 18*b*.

Once the alignment plate and skirt 28 have been properly positioned with respect to the radiator cap 18, the lever handles 22*a* and 24*a* are manually compressed toward each other to bring the gripping jaw 24*c* into gripping contact with the radiator cap sidewall opposite the skirt 28. The lever handles 22*a* and 24*a* are preferably close enough to each other to permit a user to squeeze them together with a single hand. The gripping jaw 24*b* is relatively narrow (extending less than 5° of the radiator cap's periphery) to provide relatively high unit forces for firmly gripping the cap. Thus, as the lever handles 22*a*, 24*a* are manually squeezed toward each other, the radiator cap 18 is compressingly engaged on opposite sides by the skirt and gripping jaw respectively. The mechanical advantage offered by the levers 22 and 24 further enables high compressive forces to be developed manually. The resultant frictional forces of the compressive engagement, coupled with the abutment forces of skirt 28 against the lugs, enable the user to apply a very high rotational force against the radiator cap without slippage to unscrew the cap from the neck 12. Additionally, the lever handles extend radially outward from the rotational axis of the cap to increase the torque applied to the cap 18 when the user twists the tool engaged with the cap. Moreover, the cap 18 remains firmly within the grasp of the tool after removal from the radiator to permit the cap to be carried to a convenient location.

In summary, numerous benefits have been described which result from employing the concepts of the invention. The invention provides a uniquely configured tool adapted for alignment and engagement with a radiator cap for a radiator of an internal combustion engine. The tool has a pair of pivotally connected levers that provide a mechanical advantage for both compressingly engaging a radiator cap for a firm grasp and for applying an uncoupling torque to unscrew the cap for removal from a radiator. One of the levers has a substantially planar alignment surface for matching engagement with the top of a radiator cap to assist in properly orienting and aligning the tool with respect to the cap. Further tool alignment is provided by a skirt orthogonally depending from the alignment surface. The other lever has a relatively narrow gripping jaw to engage the sidewall of the cap opposite the skirt with a relatively high unit compressive force. The skirt depends downwardly from an arcuate peripheral sector of the alignment surface and has end walls for positively engaging radially extending lugs of the radiator cap. The combined effects of the firm grip provided by the cooperating jaw end skirt and the positive abutment between the skirt and the cap lugs prevent relative rotational movement between the tool and radiator cap as high torque is applied to unscrew the cap. Each of the levers have handle portions designed for one handed manual compression to effectuate and mechanically multiply force to the radiator cap to assist in unscrewing and removing a hot or hard to remove cap from a radiator.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention and various embodiments and with various modifications as are suited to the particular use contemplated. It is intended that the scope of the invention be defined by the claims appended hereto.

I claim:

1. An apparatus for firmly grasping and removing radiator caps from radiators, comprising:

(a) a first L-shaped lever, said first lever having a first handle portion extending in a first predetermined direction and an end effector portion integrally joined to said handle portion, said end effector portion extending in a second predetermined direction substantially perpendicular to said first predetermined direction, said first and second directions defining a first plane;

(b) a second L-shaped lever pivotally attached to said first lever, said second lever having a second handle portion extending in a third predetermined direction and a gripping portion integrally joined to said handle portion extending in a fourth predetermined direction, said fourth predetermined direction being substantially perpendicular to said third predetermined direction, said third and fourth directions defining a second plane substantially parallel to said first plane;

(c) a substantially planar alignment plate having a peripheral sector of arcuate configuration, said alignment plate being rigidly secured to said end effector portion of said first L-shaped lever and extending in a plane substantially perpendicular to the first and second planes;

(d) an arcuate skirt depending from the arcuate peripheral sector of the alignment plate for less than 180°, said skirt being adapted to engage a radiator cap sidewall and to abut radially extending lugs of the radiator cap; and (e) a gripping jaw on said gripping portion of said second L-shaped lever, said gripping jaw being pivotally movable with respect to said first L-shaped lever toward the center of the arcuate skirt to grip an interposed radiator cap as the handle portions of the first and second levers are pivotally moved toward each other.

2. An apparatus as recited in claim 1 further including a pivot pin extending substantially perpendicular to said first and second planes, said first and second levers being pivotally attached to each other about said pivot pin.

3. An apparatus as recited in claim 2 wherein said arcuate skirt is orthogonally oriented with respect to said alignment plate and said first and second planes.

4. An apparatus as recited in claim 3 wherein the arcuate skirt depends from a first side of the alignment plate, and the gripping jaw is positioned proximal to the opposite side.

5. An apparatus as recited in claim 4 wherein said end effector portion of said first L-shaped lever is rigidly attached to the opposite side of said alignment plate.

6. An apparatus as recited in claim 5 wherein said gripping jaw is relatively narrow in relationship to said skirt to produce relatively high unit forces between the gripping jaw and a radiator cap for gripping an interposed cap as the handle portions of the first and second levers are pivotally moved toward each other.

* * * * *